United States Patent [19]

Inoue et al.

[11] Patent Number: 4,487,188

[45] Date of Patent: Dec. 11, 1984

[54] FUEL SYSTEM FOR INTERNAL COMBUSTION ENGINE

[75] Inventors: Ryuzaburo Inoue, Yamato; Shoji Tange, Yokosuka; Yasuhiko Nakagawa, Kamakura, all of Japan

[73] Assignee: Nissan Motor Company, Limited, Yokohama, Japan

[21] Appl. No.: 443,679

[22] Filed: Nov. 22, 1982

[30] Foreign Application Priority Data

Nov. 25, 1981 [JP] Japan ..... 56-188901

[51] Int. Cl.[3] ..... F02N 17/00; F02D 5/02

[52] U.S. Cl. ..... 123/491; 123/179 L

[58] Field of Search ..... 123/179 L, 491

[56] References Cited

U.S. PATENT DOCUMENTS

| | | | |
|---|---|---|---|
| 2,966,902 | 1/1961 | Nallinger | 123/179 L X |
| 3,020,905 | 2/1962 | Goschel et al. | 123/179 L |
| 3,533,381 | 10/1970 | Schmid et al. | 123/491 |
| 3,614,945 | 10/1971 | Schlagmuller et. al. | 123/179 L |
| 3,847,130 | 11/1974 | Miyoshi et al. | 123/179 L |
| 3,960,118 | 6/1976 | Konomi et al. | 123/491 X |
| 4,242,992 | 1/1981 | Kawamura et al. | 123/179 L X |

*Primary Examiner*—Tony M. Argenbright

*Attorney, Agent, or Firm*—Schwartz, Jeffery, Schwaab, Mack, Blumenthal & Koch

[57] ABSTRACT

A fuel system includes a motor-driven pump which pressurizes a source of fuel to a predetermined pressure level and delivers the pressurized fuel to an engine-driven pump which, in turn, communicates with high-pressure fuel injectors for supplying high-pressure fuel into respective cylinders of an engine during normal engine operation. A low-pressure fuel injector is provided which is connected to the discharge side of the motor-driven pump for supplying low-pressure fuel into an engine intake manifold near its entrance only during the engine is being cranked.

4 Claims, 2 Drawing Figures

FUEL SYSTEM FOR INTERNAL COMBUSTION ENGINE

BACKGROUND OF THE INVENTION

This invention relates to a fuel system for use in an internal combustion engine for directly injecting high-pressure fuel into engine cylinders.

Fuel systems have been proposed which employ high-pressure fuel injectors for injecting directly into engine combustion chambers vehicular gasoline fuel pressurized to a high pressure level. In such fuel systems, a motor-driven, low-pressure pump pressurizes a source of fuel and delivers the pressurized fuel to an engine-driven, high-pressure pump which, in turn, communicates with the high-pressure fuel injectors. The engine-driven pump operates at low speeds and pressurize the fuel to an insufficient pressure level when the engine is being cranked. In order to provide a compensation for this problem, it is the conventional practice to place, upstream of the engine-driven pump, a motor-driven, high-pressure pump which is actuated to compensate for the lack of fuel pressure to the injectors when the engine is being cranked. However, such motor-driven, high-pressure pump is expensive and heavy and requires a large volume of space for equipment.

The present invention provides an improved fuel system of the type dirctly injecting fuel into engine combustion chambers which can supply fuel in sufficient amounts over the full range of engine operation without the requirement for any expensive, heavy and space consuming, motor-driven, high-pressurem pump.

SUMMARY OF THE INVENTION

There is provided, in accordance with the present invention, a fuel system for an internal combustion engine having an intake manifold branched to respective cylinders of the engine. The fuel system includes a source of fuel, a motor-driven pump connected to the fuel source for discharging, at its discharge side, fuel pressurized to a predetermined pressure level, an engine-driven pump connected to the motor-driven pump discharge side for discharging, at its discharge side, fuel pressurized to varying pressure levels as a function of engine speed, a plurality of high-pressure fuel injectors connected to said engine-driven pump discharge side for injecting fuel into the respective cylinders, and a low-pressure fuel injector connected to the motor-driven pump discharge side for injecting fuel into the intake manifold near its entrance. A control unit is provided which maintains the high-pressure fuel injectors disabled to terminate fuel supply to the engine cylinders while operating the low-pressure fuel injector to supply, into the intake manifold, fuel in amounts varying as a function of at least one engine operating parameter when the fuel pressure is below a predetermined pressure level at the discharge side of the engine-driven pump. The control unit operates the high-pressure fuel injectors to supply, into the engine cylinders, fuel in amounts varying as a function of the engine operating parameter while holding the low-pressure fuel injector to terminate fuel supply to the intake manifold after the fuel pressure reaches the predetermined pressure level.

BRIEF DESCRIPTION OF THE DRAWINGS

The details as well as other features and advantages of this invention are set forth below and are shown in the accompanying drawings, in which.

DETAILED DESCRIPTION OF THE INVENTION

Figure 1:
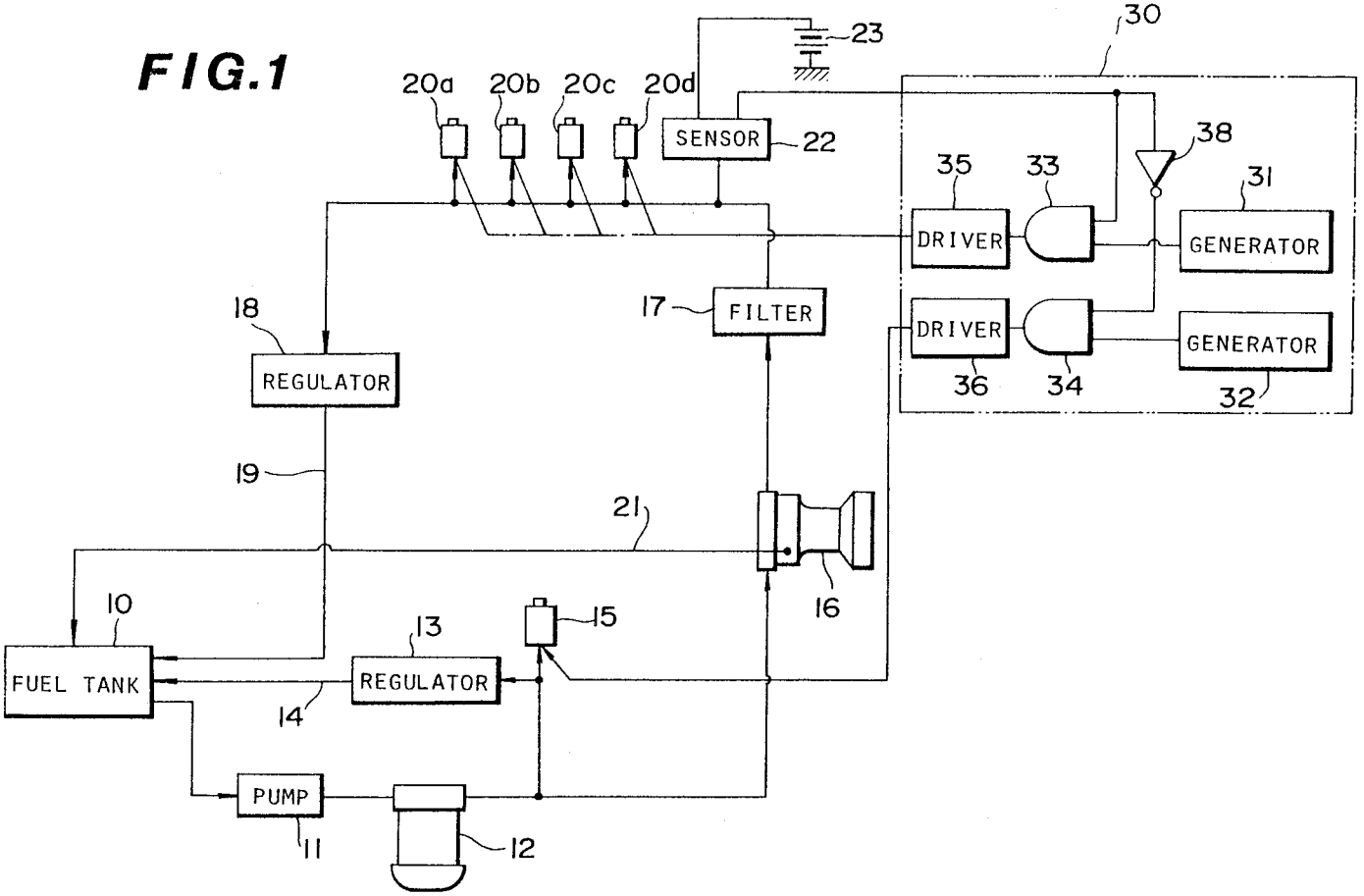
FIG. 1 is a schematic diagram showing one embodiment of a fuel system made in accordance with the present invention.

A source of fuel as, for example, a vehicular gasoline tank 10, supplies fuel to a motor-driven, low-pressure pump 11 which, in turn, delivers fuel under low pressure through a fuel filter 12 to a low-pressure fuel injection solenoid valve 15 and also to an engine-driven, high-pressure pump 16. A fuel pressure regulator 13 is connected to the fuel filter 12 and through a return passage 14 to the fuel tank 10. The pressure regulator 13 maintains the fuel pressure at the discharge side of the fuel filter 12 at a predetermined low level of about 1 $Kg/cm^2$ to 2.5 $Kg/cm^2$. This regulation is accomplished by a variation in the amount of excess fuel returned by the regulator 13 through the return passage 14 to the fuel tank 10. The low-pressure fuel injector 15 opens into an engine intake manifold (not shown) near its entrance for supplying fuel to all engine cylinders.

The engine-driven, high-pressure pump 16 is drivingly connected through a V-belt to an engine crankshaft (not shown) for discharging fuel pressurized to varying pressure levels as a function of engine speed. The pump 16 delivers fuel through a fuel filter 17 to high-pressure, fuel injection solenoid valves 15*a* to 15*d* which open directly into the respective cylinders for supplying fuel thereinto. A fuel pressure regulator 18 is connected to the fuel filter 17 and through a return passage 19 to the fuel tank 10. The pressure regulator 11 maintains the fuel pressure at the discharge side of the fuel filter 17 at a predetermined high level. This regulation is accomplished by a variation in the amount of excess fuel returned by the regulator 18 through the return passage 19 to the fuel tank 10. Another return passage 21 is provided which returns excess fuel from the engine-driven pump 16 to the fuel tank 10.

A fuel pressure sensor 22 as, for example, a pressure response switch connected to a voltage source 23, generates a decision signal which goes high when the fuel pressure at the discharge side of the fuel filter 17 reaches a predetermined pressure level which may be equal to the pressure level determined by the pressure regulator 18. The output of the fuel pressure sensor 22 is connected to a control circuit 30.

The control circuit 30 includes first and second pulse generators 31 and 32, each generating a drive pulse signal having a duty ratio varying as a function of at least one engine operating parameter. The output of the first pulse generator 31 is connected to one input terminal of an AND circuit 33 whose another input terminal is connected to the output of the fuel pressure sensor 22. The output terminal of the AND circuit 33 is connected to a first drive circuit 35 which is associated with the high-pressure fuel injectors 20*a* to 20*d*. The output of the second pulse generator 32 is connected to one input terminal of an AND circuit 34 whose another input terminal is connected through a NOT circuit 38 to the output of the fuel pressure sensor 22. The output terminal of the AND circuit 34 is connected to a second drive circuit 36 which is associated with the low-pressure fuel injector 15.

When the engine is being cranked, the motor-driven pump 11 operates to pressurize the source of fuel to the low pressure level determined by the pressure regulator 13. The pressurized fuel is delivered to the low-pressure fuel injector 15 and also to the high-pressure fuel injectors 20*a* to 20*b* through the engine-driven pump 16 which is driven at low speeds insufficient to pressurize the fuel to the high pressure level determined by the pressure regulator 18. Under this condition, the pressure sensor 22 generates a low decision signal which is coupled directly to the AND circuit 33 which thereby blocks off flow of the drive pulse signal from the first pulse generator 31 to the first drive circuit 35. As a result, the first drive circuit 35 holds the high-pressure fuel injectors 20*a* to 20*b* closed to terminate fuel supply into the respective cylinders therethrough.

The low output of the pressure sensor 22 is also coupled to the NOT circuit 38 which inverts it to generate a high output to the AND circuit 34 which thereby permits flow of the drive pulse signal from the second pulse generator 32 to the second drive circuit 36. As a result, the second drive circuit 36 operates the low-pressure fuel injector 15 to supply, into the intake manifold, fuel in amounts varying with the duty ratio of the drive pulse signal from the second pulse generator 32. Since the low-pressure fuel injector 15 opens into the intake manifold near its entrance, it can supply fuel in amounts sufficient to meet engine requirements although low-pressure fuel is supplied through the injector 15.

The engine starts operating with the fuel supplied through the low-pressure fuel injector 15. As the engine speed increases, the fuel pressure increases at the discharge side of the engine-driven pump 16. When the fuel pressure reaches the predetermined high pressure level, the output of the pressure sensor 22 goes high to permit the AND circuit 33 to pass the drive pulse signal from the first pulse generator 31 to the first drive circuit 35 which thereby operates the high-pressure fuel injectors 20*a* to 20*d* to supply, into the respective cylinders, high-pressure fuel in amounts varying with the duty ratio of the drive pulse signal from the first pulse generator 31. In contrast, the AND circuit 34 blocks off flow of the drive pulse signal from the second pulse generator 32 to the second drive circuit 34. As a result, the low-pressure fuel injector 15 is closed to terminate fuel supply into the intake manifold. These conditions continue as long as engine normal operation continues.

Consequently, the control circuit 30 maintains the high-pressure fuel injectors 20*a* to 20*d* disabled to cut off fuel supply into engine cylinders while operating the low-pressure fuel injector 15 to supply into the intake manifold low-pressure fuel in amounts varying as a function of at least one engine operating parameter when the engine is being cranked, and operates the high-pressure fuel injectors 20*a* to 20*d* to supply into the respective cylinders high-pressure fuel in amounts varying as a function of the engine operating parameter while holding the low-pressure fuel injector 15 disabled to cut off fuel supply into the intake manifold during normal engine operation.

The high-pressure fuel injectors 20*a* to 20*d* and the low-pressure fuel injector 15 may be disabled simultaneously to cut off fuel supply to the engine when the output of the pressure sensor 22 changes between its low and high levels. To avoid the possibility of complete fuel cutoff to the engine, a time delay means may be positioned in advance or arrear of the NOT circuit 38 so that the low-pressure fuel injector 15 can disabled aftr a delay with respect to a change of the pressure sensor output to a high level.

Figure 2:
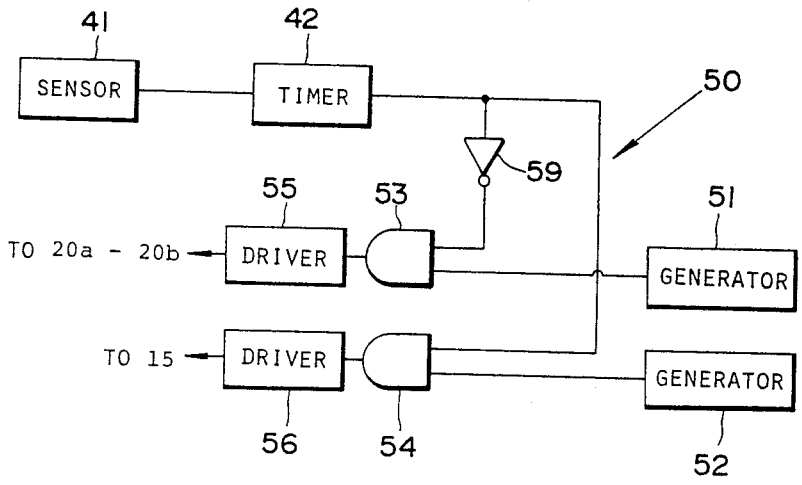
FIG. 2 is a circuit diagram showing a significant portion of another embodiment of the present invention.

Referring to FIG. 2, there is shown another embodiment of the present invention which is generally the same as shown in FIG. 1 except for the control unit design. This embodiment utilizes the fact that the time required for the fuel pressure at the discharge side of the engine-driven pump 16 to reach the predetermined high pressure level after the engine speed reaches a predetermined speed level can be obtained experimentally.

The control unit includes an engine speed sensor 41 for generating a signal which goes high when the engine speed is below a predetermined speed level. The sensor signal is coupled to a timer circuit 42 whose output changes with a delay in response to a change in the output of the engine speed sensor 41. Preferably, the delay provided by the timer circuit 42 is somewhat longer than the value obtained experimentally. The output of the timer circuit 42 is connected to a control circuit 50.

The control circuit 50 includes first and second pulse generators 51 and 52, each generating a drive pulse signal having a duty ratio varying as a function of at least one engine operating parameter. The output of the first pulse generator 51 is connected to one input terminal of an AND circuit 53, another input terminal of which is connected through a NOT circuit 59 to the output of the timer circuit 42. The output terminal of the AND circuit 53 is connected to a first drive circuit 55 which is associated with the high-pressure fuel injectors 20*a* to 20*d*. The output of the second pulse generator 52 is connected to one input terminal of an AND circuit 54 whose another input terminal is connected to the output of the timer circuit 42. The output terminal of the AND circuit 54 is connected to a second drive circuit 56 which is associated with the low-pressure fuel injector 15.

When the engine is cranked and the engine speed is below the predetermined speed level, the output of the engine speed sensor 41 remains high and thus the output of the timer circuit 42 remains high. As a result, the AND circuit 53 blocks off flow of the drive pulse signal from the first pulse generator 51 to the first drive circuit 55 so as to hold the high-pressure fuel injectors 20*a* to 20*d* disabled to stop fuel supply therethrough into the engine cylinders. In contrast, the AND circuit 54 permits flow of the drive pulse signal from the second pulse generator 52 to the second drive circuit 56, causing the low-pressure fuel injector 15 to operate to supply, into the intake manifold near its entrance, low-pressure fuel in amounts varying with the duty ratio of the drive pulse signal from the second pulse generator 52.

The engine starts operating at increasing speeds with the fuel supplied through the low-pressure fuel injector 15. When the engine speed reaches the predetermined speed level, the output of the engine speed sensor 41 goes low but the output of the timer circuit 42 still remains high. As a result, the control circuit 50 continuously maintains the high-pressure fuel injectors 20*a* to 20*d* disabled to cut off fuel supply into the engine cylinders while operating the low-pressure fuel injector 15 to supply into the intake manifold low-pressure fuel.

After the delay provided by the timer circuit 42; that is, when the fuel pressure reaches the predetermined high level at the discharge side of the engine-driven pump 16, the output of the timer circuit 42 goes low to permit the AND circuit 53 to pass the drive pulse signal from the first pulse generator 51 to the first drive circuit 55 which thereby operates the high-pressure fuel injectors 20*a* to 20*d* to supply, into the respective cylinders, high-pressure fuel in amounts varying with the duty ratio of the drive pulse signal from the first pulse generator 51. In contrast, the AND circuit 54 blocks off flow of the drive pulse signal from the second pulse generator 52 to the second drive circuit 54. As a result, the low-pressure fuel injector 15 is disabled to terminate fuel supply into the intake manifold.

While the present invention has been described in conjunction with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. A fuel system for an internal combustion engine having an intake manifold branched to respective cylinders of said engine, said fuel system comprising:

(a) a source of fuel;

(b) a motor-driven pump connected to said fuel source for discharging, at its discharge side, fuel pressurized to a predetermined pressure level;

(c) an engine-driven pump connected to said motor-driven pump discharge side for discharging, at its discharge side, fuel pressurized to varying pressure levels as a function of engine speed;

(d) a plurality of hgh-pressure fuel injectors connected to said engine-driven pump discharge side for injecting fuel into said respective cylinders;

(e) a low-pressure fuel injector connected to said motor-driven pump discharge side for injecting fuel into said intake manifold near its entrance; and (e) a control unit adapted to maintain said high-pressure fuel injectors disabled to stop fuel supply to said engine cylinders while operating said low-pressure fuel injector to supply, into said intake manifold, fuel in amounts varying as a function of at least one engine operating parameter when the fuel pressure is below a predetermined high pressure level at said engine-driven pump discharge side, said control unit operating said high-pressure fuel injectors to supply, into said engine cylinders, fuel in amounts varying as a function of the engine operating parameter while holding said low-pressure fuel injector to terminate fuel supply to said intake manifold after the fuel pressure reaches the predetermined high pressure level.

2. The fuel system of claim 1, wherein said control unit comprises a decision circuit adapted to generate a decision signal until the fuel pressure at said engine-driven pump discharge side reaches the predetermined high pressure level, and a control circuit responsive to the decision signal from said decision circuit for disabling said high-pressure fuel injectors and operating said low-pressure fuel injector, said control circuit being adapted to operate said high-pressure fuel injectors while disabling said low-pressure fuel injector in the absence of the decision signal.

3. The fuel system of claim 2, wherein said decision circuit comprises a pressure responsive switch connected to a voltage source for generating a sensor signal which changes from a first level to a second level when the fuel pressure at said engine-driven pump discharge side reaches the predetermined high pressure level.

4. The fuel system of claim 2, wherein said decision circuit comprises an engine speed sensor for generating a sensor signal which changes from a first level to a second level when the engine speed reaches a predetermined speed level, and a timer circuit whose output changes with a delay in response to a change of the sensor signal level, said delay corresponding to a time required for the fuel pressure at said engine-driven pump discharge side to reach the predetermined high pressure level after the engine speed reaches the predetermined speed level.

* * * * *